United States Patent [19]

Jostler

[11] Patent Number: 4,493,683

[45] Date of Patent: Jan. 15, 1985

[54] METHOD OF MANUFACTURING BAG-LIKE PACKAGING BLANKS PROVIDED WITH CLOSURE RIBBONS

[75] Inventor: Jan Jostler, Halmstad, Sweden

[73] Assignee: Joker System Aktiebolaget, Halmstad, Sweden

[21] Appl. No.: 425,073

[22] PCT Filed: Jan. 18, 1982

[86] PCT No.: PCT/SE82/00014

§ 371 Date: Sep. 7, 1982

§ 102(e) Date: Sep. 7, 1982

[87] PCT Pub. No.: WO82/02514

PCT Pub. Date: Aug. 5, 1982

[30] Foreign Application Priority Data

Jan. 20, 1981 [SE] Sweden ..... 8100289

[51] Int. Cl.[3] ..... B65D 33/28

[52] U.S. Cl. ..... 493/225; 156/70; 383/75

[58] Field of Search ..... 493/225; 383/72–76; 156/70

[56] References Cited

U.S. PATENT DOCUMENTS 2,897,729 8/1959 Ashton et al. ..... 493/225 X 3,592,379 7/1971 Nakamura ..... 383/75 X 3,687,357 8/1972 Hansen ..... 383/72

3,772,968 11/1973 Ruder ..... 493/225

4,260,003 4/1981 Hendrickson ..... 383/72

*Primary Examiner*—David Simmons

*Attorney, Agent, or Firm*—Roberts, Spiecens & Cohen

[57] ABSTRACT

The present invention relates to a method of manufacturing bag-like packages of flexible material, in which each package is so arranged as to have a number of closure ribbons (38, 48). A blank belt (1) which is essentially double-folded in its longitudinal direction is divided into a number of consecutive, bag-like packaging blanks (7). A number of closure ribbons (38*a, b* and 48*a, b*) extend through similarly located channels in all the packaging blanks. The ribbons are shortened in their longitudinal direction, for instance by folding. The blank belt is moved over guide devices (6*a, b*) which open the packaging blanks at the same time as the distance between their openings (32″, 32‴) increases. This causes drawing out of sections of the closure ribbons (38, 48) from the channels in the adjacent packaging blanks. The drawn-out closure ribbons are attached to each other in pairs and are cut off at the areas of attachment so as to form endless closure ribbons for each and every one of the packaging blanks. The packaging blanks are then removed from the blank belt.

11 Claims, 7 Drawing Figures

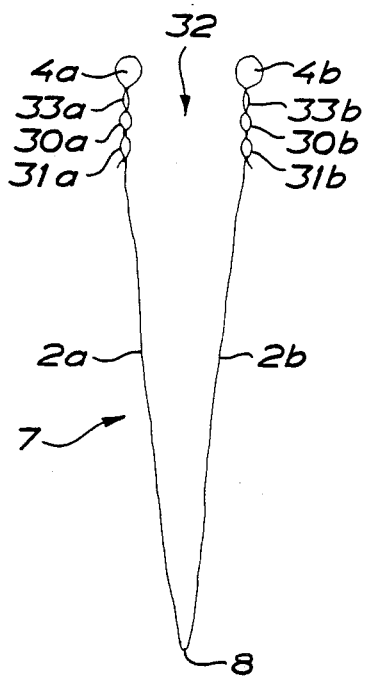
FIG. 2
FIG.4a
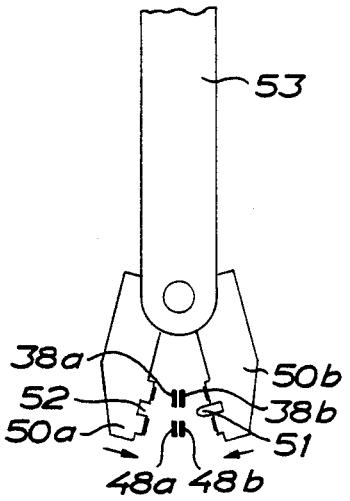
FIG. 5a
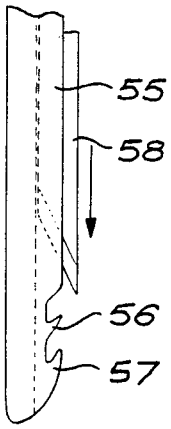
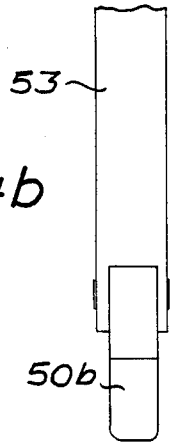
FIG.4b
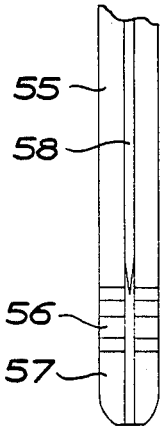
FIG.5b

METHOD OF MANUFACTURING BAG-LIKE PACKAGING BLANKS PROVIDED WITH CLOSURE RIBBONS

FIELD OF THE INVENTION

The present invention relates to a method of manufacturing from flexible material bag-like packaging blanks provided with closure ribbons, said method consisting of feeding a belt of packaging blanks arranged one after the other and capable of being separated from each other and cooperating with guide devices for opening the packaging blanks, each of the opposing side walls of the blank belt being provided in the vicinity of the openings of the packaging blanks with at least one channel extending in the longitudinal direction of the packaging belt, and at least one closure ribbon, which has been shortened, for instance, by folding, being arranged in the channel.

PRIOR ART

From the prior art it is known the use of bag-like packages of flexible material, e.g. plastic film, in which each package is provided with a number of endless closure ribbons which run in channels adjacent to the opening of the package. In addition to providing a means of closing the package, the ribbons are often also used as a hanging device. This type of package is used particularly for health products, such as cotton wool, paper handkerchieves and bath salts, etc.

The use of the aforesaid packages has been limited to a certain extent by their price. The high unit cost of the packages is due to the absence of a simple and expedient method of providing the packages with the endless closure ribbons. Thus, the use of packages with closure ribbons results in high packaging costs, which are often almost twice as high as the cost of using packages without closure ribbons.

Previously disclosed in Swedish Pat. No. 189 062 is a method for providing bags with loops or tunnels for drawstrings, whereby the walls of the bag are welded together at its opening. The patent provides no solution for inserting the strings in the tunnels and for attaching the sections of string to each other. A device for manufacturing bags with drawstrings is described in Swedish Pat. No. 189 583, in which the blank belt is provided with cut-outs for the subsequent exposure of the strings, although the blank belt has no upper edge areas with suspension devices intended to cooperate with special guiding devices designed to exposure sections of string so that they may be attached to each other and cut off. Instead of cut-outs, Danish Pat. No. 100 014 proposes that holes be produced through the blank belt enabling the strings to be exposed. According to Finnish Pat. No. 51 068 cut-outs are also produced in the belt from which ribbons are drawn out to form loops, said ribbons being joined together in pairs at the same time as transverse joints are produced in the belt so as to form bags. British Pat. No. 1,509,639 also describes a device for the filling of bags made of textile material and arranged in a continous line, although it makes no mention of closure ribbons or of the fact that the packaging blanks are to be provided with channels for such closure ribbons. Also, the line of blanks in accordance with the latter mentioned patent is not provided with strip-like edge areas incorporating suspension devices which cooperate with guide devices for the purpose of exposing the closure ribbons so that they may be attached to each other.

SUMMARY OF THE INVENTION

An object of the present invention is to produce packages provided with closure ribbons by a new method, which provides considerably reduced packaging costs compared with previously used techniques, and which is simple and reliable in operation with the closure ribbons between the packages being easily accessible to welding jaws or other fixing devices. The operation of the method produces no loops in the ribbons and calls for no devices for deflecting the ribbon away from the belt, as is required in the arrangements which have already been known.

The invention is characterized principally in that adjacent to its free edges the blank belt is provided with opposing strip-like areas in the vicinity of the edges, which areas link the packaging blanks together and which provide suspension means for cooperating with guide devices which control the positions of the areas in the vicinity of the edges relative to each other; in that at least one of the packaging blanks is opened by the guide devices as the blank belt advances whereas said areas in the vicinity of the edges being moved apart in order at the same time to increase the distance between the openings of two adjacent packaging blanks so that parts of the closure ribbons are drawn out of the channels in the packaging blanks; and in that the closure ribbons are attached in pairs in the area of said drawn-out parts by a method known per se, and are cut off in the attachment areas so as to form endless closure ribbons in each packaging blank.

A preferred embodiment of the invention has slits arranged essentially at right angles to the longitudinal direction of the belt, said slits separating the packaging blanks from each other, as well as slits arranged essentially in the longitudinal direction of the belt and located at the transition between the packaging blanks and the stripe-like areas in the vicinity of the edges, said slits separating parts of the edges of the openings of the packaging blanks from the stripe-like areas in the vicinity of the edges. These slits are usually joined together in pairs, so that they have the form of a letter T with the blank belt seen from the side. One or more connecting bridges may be present in the slits between adjacent packaging blanks. In the areas in the vicinity of the edges the blank belt is also provided with suspension devices which cooperate with devices for controlling the spacing of the areas in the vicinity of the edges relative to each other as the blank belt advances in the longitudinal direction. Also present at the transition between the packaging blanks and the stripe-like areas in the vicinity of the edges are tear-off notches extending between those slits which are arranged in the longitudinal direction of the belt.

Each channel on the side wall is so positioned to form similarly positioned channels in the longitudinal direction of the blank belt. The channels are interrupted by the aforementioned slits. Inserted into the similarly positioned channels are the closure ribbons, which extend through all the packaging blanks. The closure ribbons are shortened, for instance by folding, in the longitudinal direction of the blank belt.

When producing packages from blank belts in accordance with the present invention, the suspension devices cooperate with guide devices along which the blank belt is advanced. As the belt advances, the spacing between the areas in the vicinity of the edges is increased, whereby the packaging blanks are opened at the same time as the spacing between them is increased. In conjunction with this, parts of the closure ribbons are drawn out from the channels in the adjacent packaging blanks. The closure ribbons drawn out in this way are attached to each other in pairs, for instance by welding, gluing or knotting, etc. and are cut off in the attachment areas so as to form endless closure ribbons for each and every one of the packaging blanks. The maximum distance between the openings of the fully opened packaging blank and the opening of the immediately preceding or immediately following packaging blank and consequently the maximum drawing-out of the closure ribbon and the maximum working space for attaching and cutting the closure ribbons will be achieved if the guide devices are made in such a way that, of the adjacent packaging blanks, at least that side of the opening closest to the fully open packaging blank is extended to the maximum extent permitted by the respective packaging blank.

Once the endless closure ribbons have been produced, the packaging blanks are advanced further along the guide devices in order to be separated in one or more consecutive operations from each other and also from the stripe-like areas in the vicinity of the edges.

In a preferred embodiment of the invention, welding together of the closure ribbons is achieved by means of welding jaws which hold the closure ribbons between them, at the same time as the closure ribbons for forming separate endless closure ribbons are held apart by devices located on the welding jaws.

In one embodiment of the invention, the closure ribbons which have been attached together in pairs are cut off by an operation in which hooking devices take hold of the ribbons in the area in which the ribbons are attached to each other, after which the ribbons are cut at the attachment areas by a knife-like device so as to produce the endless closure ribbons allocated to each and every one of the packaging blanks.

In an alternative embodiment of the invention, the slits are replaced either wholly or in part by tear-off notches.

In another alternative embodiment of the invention, the slits in the longitudinal direction of the blank belt are replaced by means of cutting devices which cut into the walls of the belt as it advances longitudinally in those areas in which the slits are located in accordance with the previously described embodiments of the invention. These cutting devices are preferably located adjacent to the guide devices which control the relative distance between the areas in the vicinity of the edges.

The closure ribbons consist, for instance, of cotton or plastic. In the event of the use of plastic ribbons, a material with a higher melting point than that of the film material of the blank belt must be selected in order to prevent the welding together of the film material and the closure ribbons during manufacture of the packaging blanks. Examples of suitable materials for the closure ribbons are plastic materials of the polyester or polyamide types.

As indicated above, the packaging blanks are opened in conjunction with the completion of the closure ribbons. It is appropriate in many applications to place the contents in the packaging blanks at this point.

In accordance with the patents considered above in the Prior Art section, which relate to the manufacture of packaging blanks provided with closure ribbons and the blanks arranged as a belt, the closure ribbons must be drawn out from the supply of ribbon in order to form loops, which calls for special arrangements. No such loops are fomred by the method in accordance with the present invention, instead of which sections of ribbons are exposed between two adjacent packaging blanks by causing these to be separated from each other by opening at least one of the packaging blanks in a unique manner. This in turn is based on the idea of providing the blank belt with special areas in the vicinity of the edges and of causing these areas to engage with special guide devices which move the areas in the vicinity of the edges away from each other, thereby forcing the openings of two adjacent packaging blanks to be separated from each other by a suitable distance.

BRIEF DESCRIPTION OF THE DRAWING

The present invention is described in greater detail in relation to the drawing, in which

FIG. 2 is a section through the blank belt in FIG. 1;

FIG. 4*a* and FIG. 4*b* are respectively a side view and a front view of the welding device; and FIG. 5*a* and FIG. 5*b* are respectively a side view and a front view of the cutting device.

DETAILED DESCRIPTION

Figure 1:
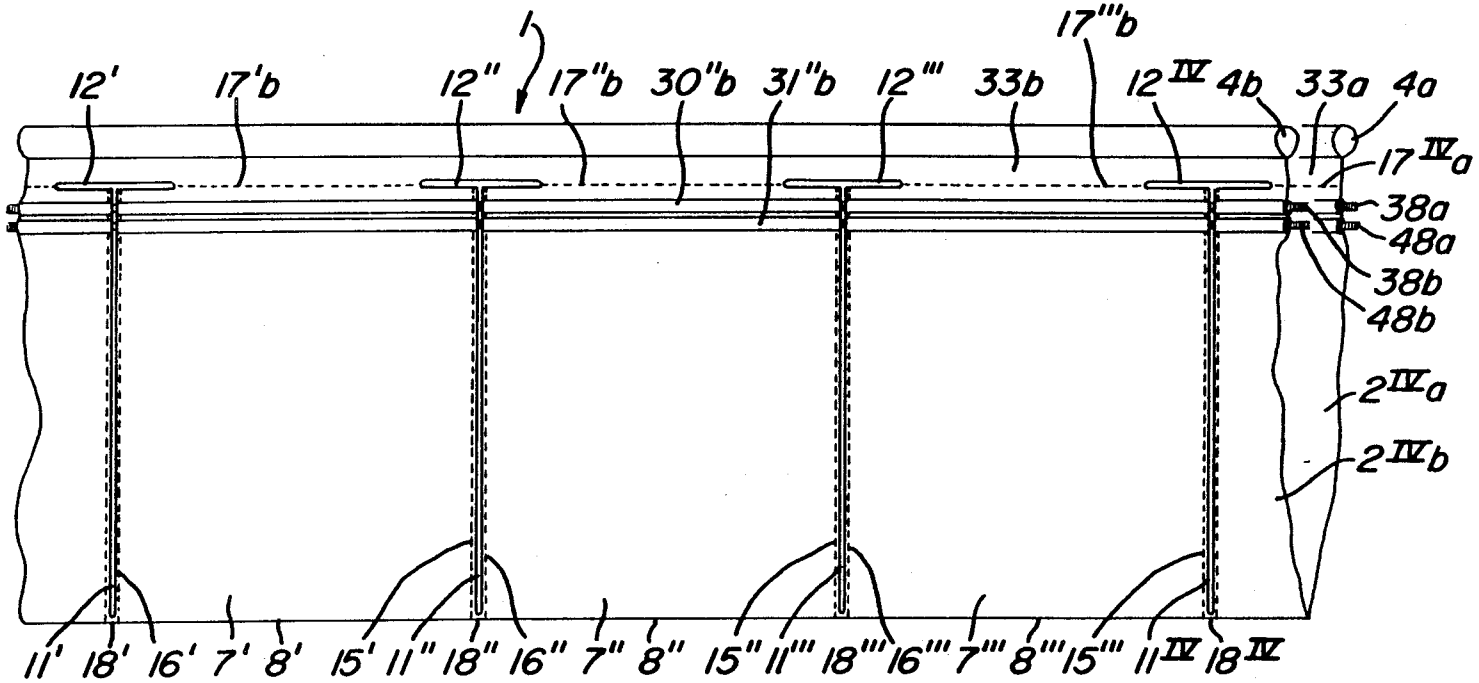
FIG. 1 shows a blank belt viewed from the side.

FIGS. 1 and 2 illustrate an essentially double-folded blank belt 1 of a flexible material, preferably a plastic film. The blank belt consists of a number of consecutive bag-like packaging blanks 7', 7'', 7'''. Each packaging blank consists of two walls 2 *a, b* which are welded or glued together along two of the areas in the vicinity of their edges so as to form joints 15, 16. A third edge of the packaging blanks, i.e. the bottom 8 of each of the packaging blanks, consists of the fold produced by the double-folding of the blank belt. Between the joints 15, 16 are slits $11'$–$11^{IV}$, shown running vertically in the Figure, which separate adjacent packaging blanks from each other. Each slit is bridged by one or more bridges $18'$–$18^{IV}$, which are shown in the Figure to be located adjacent to the bottom 8 of each packaging blank.

Located adjacent to both free edges of the double-folded blank belt are stripe-like areas 33 *a, b* in the vicinity of the edges. Each of the areas in the vicinity of the edges is joined to one of the walls 2 *a, b* of the packaging blank, with respective tear-off notches $17'a$–$17^{IV}a$ and $17'b$–$17^{IV}b$ being located at the transition between the areas in the vicinity of the edges and the walls. The tear-off notches are interrupted in the areas between two adjacent packaging blanks by slits $12'$–$12^{IV}$ shown running horizontally in the Figure, which are united with the slits $11'$–$11^{IV}$. Each of the horizontal slits delimits parts of the openings 32 (cf. FIGS. 2 and 3) of adjacent packaging blanks. Furthermore, the stripe-like areas in the vicinity of the edges are so arranged as to have loop or tunnel-like suspension devices 4 *a, b*.

In each of the areas adjacent to the stripe-like areas in the vicinity of the edges, the side walls of the packaging blanks are respectively provided with 30*a*, 31*a* and 30*b*, 31*b* running longitudinally in the direction of the blank belt. EAch of the channels on the side walls is situated in such a way that similarly situated channels are present in the longitudinal direction of the blank belt, said channels being interrupted by the vertical slits. Into each channel are introduced a number of continuous closure ribbons 38, 48 which extend through all the channels in the packaging blanks. The closure ribbons are shortened, for instance by folding, in the longitudinal direction of the blank belt.

Figure 3:
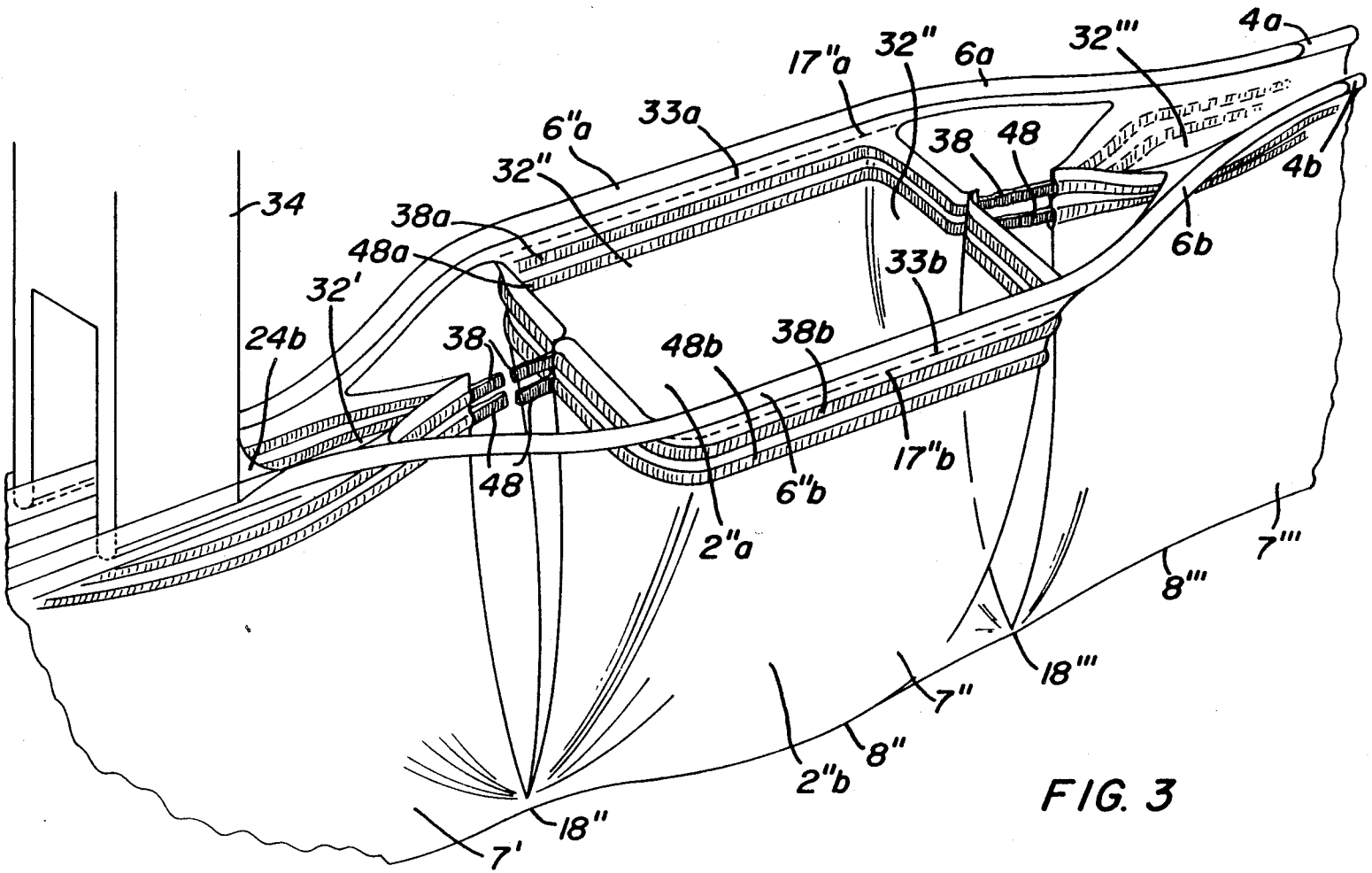
FIG. 3 is a perspective view of a blank belt passing over the device for controlling the spacing of the areas in the vicinity of the edges from each other.

FIG. 3 shows a blank belt of FIGS. 1 and 2 introduced by means of its suspension devices 4 *a,b* onto guides 6 *a, b* attached to a frame 34. The guides consist of relatively narrow rods which in the vicinity of their ends are located relatively close to each other and have central and essentially parallel parts 6″*a,* 6″*b* located at a greater distance from each other than the end sections. One of the end sections of each guide is attached to the frame 34. A cutting device is located at the point of transition between the guides and the frame and cutting blade 246 is visible in FIG. 3.

FIGS. 4*a* and 4*b* illustrate a device for welding together portions 38*a,* 38*b* to form the closure ribbons 38, 48. The welding device consists of a holder 53 at the lower end of which are arranged two welding jaws 50 *a, b* capable of being moved towards and away from each other. One of the welding jaws is fitted with a ribbon-separating device 51, which operates in conjunction with a receiving opening 52 in the other welding jaw.

FIGS. 5*a* and 5*b* illustrate a device for cutting the closure ribbons 38, 48. The device consists of a holder 55 for a knife device 58 which moves in the longitudinal direction of the holder. The holder is also provided with hooking devices 56, 57.

The holders in accordance with FIG. 4 and FIG. 5 are arranged in a device for carrying out the method in accordance with the present invention in conjunction with the guides 6 *a, b* in FIG. 3 in such a way that they are in a fixed position relative to the frame 34. In order not to obstruct the clarity of FIG. 3, both holders have been omitted from FIG. 3 although a person skilled in the art will easily appreciate that the holders can be arranged in such a way that they assume positions in those spaces formed between the packaging blanks 7‴–7″ and 7″–7′ respectively. They are thus arranged in such a way that the holders are moved by drive units in a vertical direction so that when in the lower position they will adopt operating positions in which the welding operation and the cutting operation respectively on the closure ribbons can be executed.

In the application of the present invention, the tunnel-like suspension devices 4 *a, b* on the blank belt are introduced onto rod-like guides 6 *a, b* and are moved by drive units (not shown in the Figures) along the guides. As they pass along the guides, the strip-like areas 33 *a, b* in the vicinity of the edges of the blank belt are initially moved away from each other, thereby causing the packaging blank 7″ connected to the area in the vicinity of the edge to open, after which they are brought together again, thereby causing the edges of the opening of the packaging blanks to come together once more. As they pass over the central areas 6″*a,* 6″*b* of the rod-like guides, the openings of the packaging blanks assume their maximum dimensions. The insertion of any contents is therefore appropriate in this position. As the blanks continue to advance, the tunnel-like suspension devices 4 *a, b* are cut by the cutting device causing the blank belt to be released from the guides 6 *a, b.* The cutting operation may possibly be preceded by the welding together of the packaging blanks in the area of their openings, for example in accordance with the principle illustrated in Swedish patent application Nos. 8004829-1 or 8006976-8.

As the stripe-like areas 33 *a, b* in the vicinity of the edges are moved away from each other, the size of the openings of the packaging blanks in the longitudinal direction of the blank belt is reduced, which in turn means that the distance between the openings of two adjacent packaging blanks is increased. At this time, the closure ribbons are drawn out from the channels 30*a, b,* 31*a, b* of the packaging blanks (cf. the ribbons 38, 48 between the packaging blanks 7″ and 7‴ in FIG. 3). The holder 53 for the welding jaws 50 *a, b* will assume a position in the space formed between the packaging blanks 7″ and 7‴ such that, when the welding jaws are moved towards each other, the closure ribbons 38, 48 will be pressed between the welding jaws at the same time as the upper ribbons 38 are held apart from the lower ribbons 48. Once welding has taken place, the welding jaws are moved apart and the holder 53 returns them to a position in which the movement of the blank belt along the guides 6*a, b* may continue.

At the same time as the welding jaws 50 *a, b* join the closure ribbons 38 *a, b* and 48 *a, b* to each other, the holder 55 is moved into the space between the packaging blanks 7′–7″ to a position in which the hooking devices 56, 57 will take hold of the closure ribbons 38, 48 in the areas in which they have been welded together and will lift them upwards slightly in the figure, whereupon the knife 58 is move towards the hooking devices 56, 57 and cuts off the closure ribbons 38, 48 and preserving the welded areas of the ribbons on both sides of the cut. The cutting operation completes the formation of the endless closure ribbons in the packaging blank 7′, at the same time as the initial stage in the formation of the endless closure ribbons in the following packaging blank 7″ is begun.

In FIG. 3 the central and parallel parts 6″*a,* 6″*b* of the rod-like guides are shown to have a length which largely corresponds to the length of the opening in an opened packaging blank. By extending the central and parallel parts of the guides so that not only the opened packaging blank 7″ is fully extended, but also at least the closest sides of the preceding packaging blank 7′ and of the following packaging blank 7‴, the maximum available space will be provided between the packages 7′–7″ and 7″–7‴ respectively. In this way, sufficient working space will usually be available for the welding devices and cutting devices. If necessary, the horizontal slits $12'$–$12^{IV}$ may be extended in order to further increase the space between the packaging blanks.

The bridges between the packaging blanks are cut at an appropriate stage, for example in conjunction with the cutting off of the closure ribbons 38, 48.

The the present invention has been described in relation to a double-folded flexible material, in which the fold formed by the double-folding operation produces the bottom of each packaging blank. The invention is also suitable for other types of blank belts, for instance those formed by welding together two separate belts of material.

What is claimed is:

1. A method of manufacturing bag-like packaging blanks of flexible material provided with respective closure ribbons, said method comprising feeding a belt of packaging blanks arranged one after the other and capable of being separated from each other, engaging the belt with guide devices to open the packaging blanks by moving opposing side walls of the blank belt away from one another at the upper edges of the belt, each of the walls of the belt having, in the vicinity of the upper edge of the packaging blanks, at least one channel extending in the longitudinal direction of the blank belt, in which channel is arranged at least one closure ribbon which has been shortened in length, the blank belt being further provided with opposed strip-like areas in the vicinity of the upper edges, which join the packaging blanks together and provide suspension regions adapted to be engaged by the guide devices for guiding the blanks thereon, to open the blanks as the belt advances while concurrently increasing the distance between two adjacent packaging blanks so that parts of the closure ribbons are drawn out of the channels in the packaging blanks and are exposed between adjacent blanks joining the thus exposed closure ribbons between the adjacent blanks and cutting the now joined ribbons to form endless closure ribbons in each packaging blank.

2. A method as claimed in claim 1, wherein said closure ribbons are attached in pairs between adjacent blanks.

3. A method as claimed in claim 1, wherein said closure ribbons are shortened to between about 30–80% of their original length before being inserted in the channels.

4. A method as claimed in claim 2, wherein the attachment of the closure ribbons to each other in pairs is effected by welding.

5. A method as claimed in claim 2, wherein the attachment of the closure ribbons to each other in pairs is effected by gluing.

6. A method as claimed in claim 2, wherein the attachment of the closure ribbons to each other in pairs is effected by a knotting operation in which two knots located adjacent to each other are formed and the closure ribbons are separated between the knots.

7. A method as claimed in claim 2, wherein the area for the attachment of the closure ribbons to each other is given sufficient length in each area of attachment so that, when the closure ribbons in the area of attachment are cut, connections can be effected between closure ribbons belonging to two separate packaging blanks located adjacent to each other.

8. A method as claimed in claim 1, wherein the closure ribbons are made of a material which is not capable of being welded to the material of the belt.

9. A method as claimed in claim 1, wherein, when guiding the areas in the vicinity of the upper edges to move away from each other, one packaging blank is opened fully while at the same time the opening sides of the adjacent blanks are extended to the maximum permissible length.

10. A method as claimed in claim 9, wherein said blank belt is provided with slits at the point of transition between the packaging blanks and between the strip-like areas in the vicinity of the upper edges, each slit separating parts of the openings of two adjacent packaging blanks from each other, the length of each slit and the distance between central and parallel parts of the guide devices being related so that, as the packaging blanks pass over said parts, the distance between the openings of adjacent packaging blanks will permit the introduction of means for joining the closure ribbons to each other and for cutting them in the area of the attachment.

11. A method as claimed in claim 10, wherein the blank belt is provided with transverse slits which separate the packaging blanks from each other, said transverse slits being connected by breakable bridges to the first said slits.

* * * * *